United States Patent [19]

Johnson et al.

[11] Patent Number: 4,849,095

[45] Date of Patent: Jul. 18, 1989

[54] PROCESS FOR HYDROGENATING A HYDROCARBONACEOUS CHARGE STOCK

[75] Inventors: Russell W. Johnson, Elmhurst; Walter F. Hribik, La Grange Park; Lee Hilfman, Mount Prospect, all of Ill.

[73] Assignee: UOP, Des Plaines, Ill.

[21] Appl. No.: 47,342

[22] Filed: May 8, 1987

Related U.S. Application Data

[63] Continuation-in-part of Ser. No. 793,939, Nov. 1, 1985, abandoned.

[51] Int. Cl.[4] ..... C10G 45/04

[52] U.S. Cl. ..... 208/254 H; 208/212; 208/213; 208/262.1; 208/301; 208/305; 208/262.5; 210/673; 210/691; 210/694; 210/806; 210/909; 502/22; 502/55; 502/514; 502/515; 502/516

[58] Field of Search ..... 208/212, 96, 99, 251 R, 208/251 H, 262, 301, 305, 283, 285, 288, 81, 83, 97, 177, 299, 302, 303, 310 R, 228, 235, 254 H; 210/673, 691, 694, 806, 909; 502/22, 55, 514, 515, 516, 517, 518; 585/820, 826, 841

[56] References Cited

U.S. PATENT DOCUMENTS

| | | | |
|---|---|---|---|
| 2,921,896 | 1/1960 | Jezl | 208/212 |
| 3,340,182 | 9/1967 | Berkman et al. | 208/254 H |
| 3,694,350 | 9/1972 | Wennerberg | 208/228 |
| 3,855,347 | 12/1974 | Oricchio | 260/683.9 |
| 3,893,913 | 7/1975 | Zimmerman | 208/253 |
| 4,105,542 | 8/1978 | Fainman | 208/180 |
| 4,124,528 | 11/1978 | Modell | 252/411 R |
| 4,160,729 | 7/1974 | Wilcox | 210/691 |
| 4,202,766 | 5/1980 | Ono et al. | 210/40 |
| 4,405,448 | 9/1983 | Googin et al. | 208/262 |
| 4,428,828 | 1/1984 | Bose | 208/208 R |
| 4,465,589 | 8/1984 | Kukes et al. | 208/208 R |

*Primary Examiner*—H. M. Sneed
*Assistant Examiner*—Helane Myers
*Attorney, Agent, or Firm*—Thomas K. McBride; John G. Tolomei; John G. Cutts, Jr.

[57] ABSTRACT

A process for hydrogenating a hydrocarbonaceous charge stock containing nitrogen, sulfur or halogen-based impurities which process comprises the steps of: (a) contacting the hydrocarbonaceous charge stock in the presence of hydrogen with a hydrogenation catalyst in a hydrogenation reaction zone to simultaneously increase the hydrogen content of the hydrocarbonaceous charge stock and to generate at least one water-soluble inorganic compound produced from the reaction of said nitrogen, sulfur or halogen-based impurities in said hydrocarbonaceous charge stock and the hydrogen; (b) contacting the reaction zone effluent containing hydrogenated hydrocarbonaceous compounds and at least one said water-soluble inorganic compound with a fresh aqueous scrubbing solution; (c) introducing a resulting admixture of the reaction zone effluent and the aqueous scrubbing solution into a separation zone to provide a hydrogenated hydrocarbonaceous stream and a spent aqueous scrubbing solution stream containing at least a portion of the water-soluble inorganic compound and trace quantities of hydrogenated hydrocarbonaceous compounds; (d) contacting the spent aqueous scrubbing solution stream with an adsorbent to remove the trace quantities of the hydrocarbonaceous compounds from the aqueous scrubbing solution stream thereby providing an aqueous stream essentially free from hydrocarbonaceous compounds; (e) removing the hydrocarbonaceous compounds from spent adsorbent with an elution solvent thereby regenerating the adsorbent; and (f) passing the elution solvent in admixture with hydrocarbonaceous compounds which are removed from the spent adsorbent in step (e) into the hydrogenation reaction zone of step (a) thereby recovering the hydrocarbonaceous compounds.

11 Claims, 1 Drawing Sheet

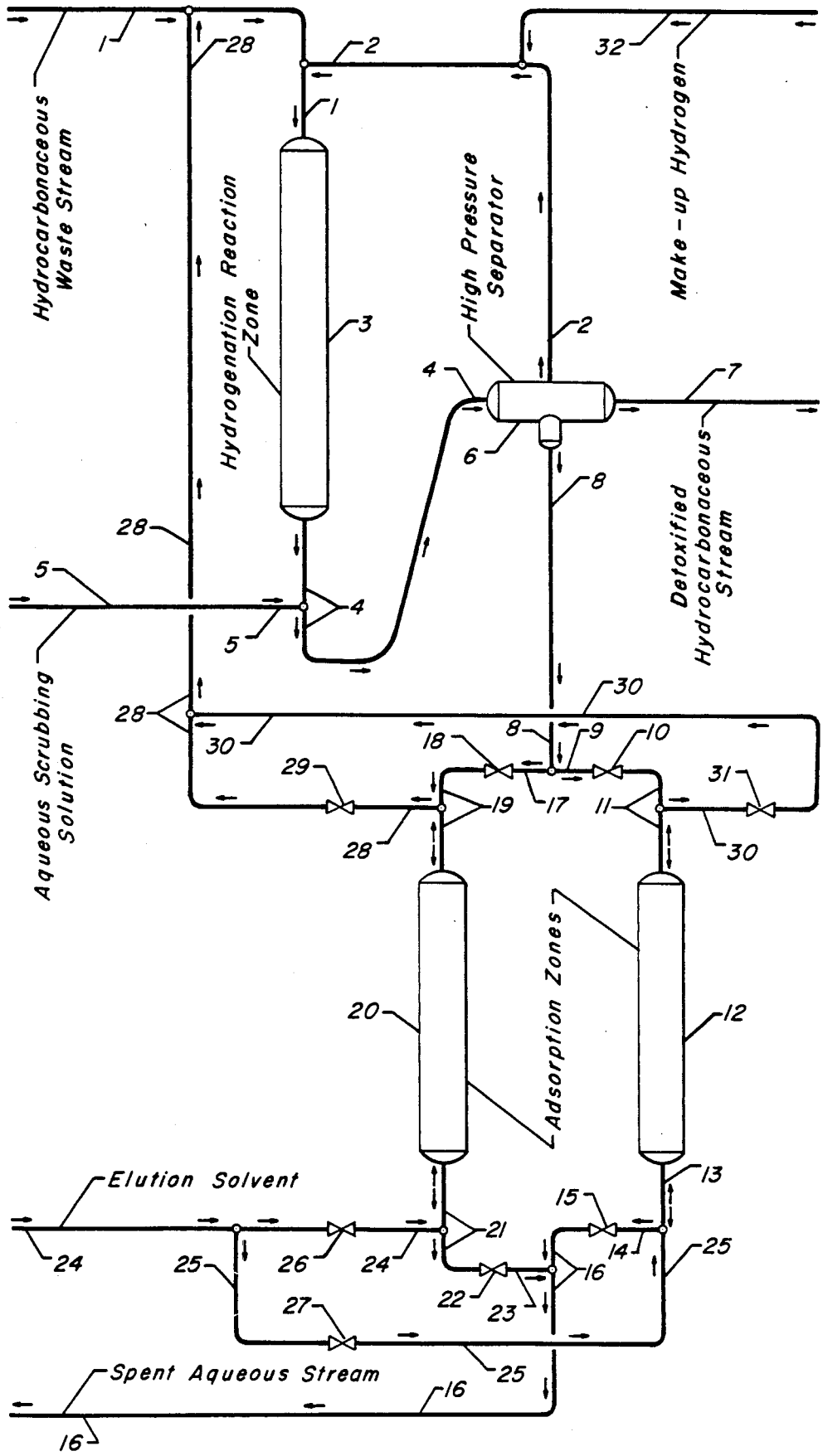
Hydrocarbonaceous Waste Stream
Hydrogenation Reaction Zone
High Pressure Separator
Make-up Hydrogen
Detoxified Hydrocarbonaceous Stream
Aqueous Scrubbing Solution
Adsorption Zones
Elution Solvent
Spent Aqueous Stream

PROCESS FOR HYDROGENATING A HYDROCARBONACEOUS CHARGE STOCK

CROSS REFERENCE TO RELATED APPLICATION

This application is a continuation-in-part of application Ser. No. 793,939 filed Nov. 1, 1985 now abandoned all the teachings of which copending application are incorporated herein by specific reference thereto.

BACKGROUND OF THE INVENTION

The field of art to which this invention pertains is the hydrogenation of a hydrocarbonaceous charge stock. More particularly, the invention relates to hydrogenating hydrocarbons containing hazardous or obnoxious hydrocarbonaceous compounds. More specifically, the invention relates to a process for hydrogenating a hydrocarbonaceous charge stock containing nitrogen, sulfur or halogen-based impurities which process comprises the steps of (a) contacting the hydrocarbonaceous charge stock in the presence of hydrogen with a hydrogenation catalyst in a hydrogenation reaction zone to simultaneously increase the hydrogen content of the hydrocarbonaceous charge stock and to generate at least one water-soluble inorganic nitrogen sulfur or halogen-based compound produced from the reaction of said nitrogen, sulfur or halogen-based impurities in the hydrocarbonaceous charge stock and the hydrogen; (b) containing the reaction zone effluent containing hydrogenated hydrocarbonaceous compounds and at least one said water-soluble inorganic compound with a fresh aqueous scrubbing solution; (c) introducing the resulting admixture of the reaction zone effluent and the aqueous scrubbing solution into a separation zone to provide a hydrogenated hydrocarbonaceous stream and a spent aqueous scrubbing solution stream containing at least a portion of the water-soluble inorganic compound and trace quantities of hydrogenated hydrocarbonaceous compounds; (d) contacting the spent aqueous scrubbing; solution stream with an adsorbent to remove the trace quantities of the hydrocarbonaceous compounds from the aqueous scrubbing solution stream thereby providing an aqueous stream essentially free from hydrocarbonaceous compounds; (e) removing the hydrocarbonaceous compounds from spent adsorbent thereby regenerating the adsorbent; and (f) passing the hydrocarbonaceous compounds which are removed from the spent adsorbent in step (e) into the hydrogenation reaction zone of step (a) thereby recovering the hydrocarbonaceous compounds.

INFORMATION DISCLOSURE

In U.S. Pat. No. 3,919,398 (Davis), a method is disclosed for recovering bromine as hydrogen bromide from aromatic bromides. The method involves reacting the aromatic bromide with hydrogen at a temperature within the range from about 200° to about 600° C. in the presence of a palladium activated catalyst. In U.S. Pat. No. 3,892,818 (Scarfe et al.), a method is disclosed for the conversion of hydrocarbon chlorides in the presence of hydrogen to hydrocarbons and hydrogen chloride wherein the process takes place in a gaseous phase and in the presence of rhodium-containing catalyst.

In U.S. Pat. No. 3,501,396 (Gatsis), a method is disclosed for desulfurizing an asphaltene-containing black oil in admixture with 2 to 30% by weight of water in contact with an acidic catalyst containing molybdenum and nickel.

In U.S. Pat. No. 3,855,347 (Oricchio), a method is disclosed for the hydrogenation of a halogen containing hydrocarbonaceous feedstock.

In U.S. Pat. No. 4,105,542 (Fainman), a method is disclosed for purifying used lubricating oil by removing sludge or other undesirable components with an aqueous scrubbing solution.

In U.S. Pat. No. 3,893,913 (Zimmerman), a method is disclosed for separating an organo lead compound from liquid hydrocarbons by contacting the liquid hydrocarbons containing an organo lead compound with an adsorbent to capture the organo lead.

In U.S. Pat. No. 4,124,528 (Modell), a process is disclosed for the regeneration of adsorbents by extracting adsorbates from the surface of adsorbent with a supercritical fluid. In the U.S. pat. No. 4,124,528 patent, a preferred and exemplified supercritical fluid is carbon dioxide.

It is well known in the petroleum industry that water is injected into the effluent of hydrogenation reaction zones to prevent the accumulation and eventual plugging of the heat exchange circuit and piping with salts which are produced in the hydrogenation reaction zone. The adsorption of contaminants from aqueous streams is also well known.

BRIEF SUMMARY OF THE INVENTION

The invention provides an integrated process for hydrogenating a hydrocarbonaceous charge stock containing nitrogen, sulfur or halogen-based impurities by contacting the charge stock in the presence of hydrogen with a hydrogenation catalyst in a hydrogenation reaction zone and treating a spent aqueous scrubbing solution which has been previously used to scrub the hydrocarbonaceous effluent from the hydrogenation reaction zone by contacting the spent aqueous solution with an adsorbent to remove trace quantities of hydrocarbonaceous compounds from the aqueous solution before disposal. The present invention also contemplates the recovery of the hydrocarbonaceous compounds from the adsorbent by eluting said compounds from the adsorbent and passing the recovered hydrocarbonaceous compounds into the hydrogenation reaction zone.

One broad embodiment of the invention may be characterized as a process for hydrogenating a hydrocarbonaceous charge stock containing nitrogen sulfur or halogen-based impurities which process comprises the steps of: (a) contacting the hydrocarbonaceous charge stock in the presence of hydrogen with a hydrogenation catalyst in a hydrogenation reaction zone to simultaneously increase the hydrogen content of the hydrocarbonaceous charge stock and to generate at least one water-soluble inorganic compound produced from the reaction of the nitrogen, sulfur or halogen-based impurities in the hydrocarbonaceous charge stock and the hydrogen; (b) contacting the reaction zone effluent containing hydrogenated hydrocarbonaceous compounds and at least one said water-soluble inorganic compound with a fresh aqueous scrubbing solution; (c) introducing a resulting admixture of the reaction zone effluent and the aqueous scrubbing solution into a separation zone to provide a hydrogenated hydrocarbonaceous stream and a spent aqueous scrubbing solution stream containing at least a portion of the water-soluble inorganic compound and trace quantities of hydrogenated hydrocarbonaceous compounds; (d) contacting the spent aqueous scrubbing solution stream with an adsorbent to remove the trace quantities of the hydrocarbonaceous compounds; (d) contacting the spent aqueous scrubbing solution stream with an adsorbent to remove the trace quantities of the hydrocarbonaceous compounds from the aqueous scrubbing solution stream thereby providing an aqueous stream essentially free from hydrocarbonaceous compounds; (e) removing the hydrocarbonaceous compounds from spent adsorbent thereby regenerating the adsorbent; and (f) passing the hydrocarbonaceous compounds which are removed from the spent adsorbent in step (e) into the hydrogenation reaction zone of step (a) thereby recovering the hydrocarbonaceous compounds.

Another embodiment of the invention may be characterized as a process for regenerating a spent adsorbent which contains hydrocarbonaceous compounds which process comprises the steps of: (a) eluting the hydrocarbonaceous compounds from the spent adsorbent and thereby regenerating the adsorbent; and (b) passing the hydrocarbonaceous compounds which were removed from the spent adsorbent in step (a) into a hydrogenation reaction zone.

Other embodiments of the subject invention encompass further details such as hydrocarbonaceous charge stocks, potential hydrocarbonaceous compound contaminants, aqueous scrubbing solutions, hydrogenation catalysts, adsorbents, elution solvents and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of reducing or eliminating the environmental discharge of trace quantities of hydrocarbonaceous compounds. An even greater demand is foreseen when these hydrocarbonaceous compounds are toxic, carcinogenic or otherwise obnoxious. Conventional hydrocarbon hydrogenation units have a relatively small aqueous effluent stream containing trace quantities of hydrocarbonaceous compounds and the removal of these compounds, particularly if they are obnoxious, is highly desirable before the aqueous stream is discarded. In the event that those trace hydrocarbonaceous compounds are exceedingly obnoxious, it is preferred that the hydrocarbonaceous compounds not only be removed from the aqueous phase but converted into less noxious compounds. For purposes of this invention, less noxious compounds are defined as those compounds which may be recycled or sold in legitimate commerce. Therefore, those skilled in the art have sought to find feasible and convenient techniques to remove trace amounts of hydrocarbonaceous compounds from the aqueous effluent emanating from a hydrogenation process unit and to subsequently provide for the suitable disposal of the recovered hydrocarbonaceous compounds. The present invention provides an improved hydrogenation process whereby the trace quantities of hydrocarbonaceous compounds are removed from the aqueous effluent stream.

The hydrocarbonaceous charge stock which may suitably be hydrogenated in the process of the present invention includes naphtha, kerosene, middle distillate, diesel fuel, gas oil, vacuum gas oil and reduced crude which are produced by the fractionation of petroleum crude oil. In general, suitable hydrocarbonaceous charge stocks are those stocks which derive improvement in quality when subjected to hydrogenation. Traditionally, hydrogenation has been utilized to remove sulfur, nitrogen and other contaminants from hydrocarbonaceous compounds. Suitable hydrocarbonaceous charge stocks also include hydrocarbons derived from tar sand, oil shale and coal, and may comprise sulfur, oxygen, metal or nitrogen components. A preferred class of charge stocks include halogenated hydrocarbons. Certain halogenated hydrocarbons having demonstrated or potential toxicity include but are not limited to kepone, halogenated biphenyls, halogenated cyclodienes, such as aldrin, dieldrin, and hexachlorocyclopentadienes, dibromochloropropane, halogenated phthalic anhydrides, such as polybromophthalicanhydride, tetrachloroethylene, polychlorodioxins such as tetrachlorodibenzodioxin, halogenated organic phosphates such as 2,2 dichlorovinydimethyl phosphate. Additional examples of hydrocarbonaceous compounds include organometallic compounds and especially those which contain metals such as lead, mercury, cadmium, cobalt, arsenic, vanadium and chromium. In the event that the primary hydrocarbonaceous charge stock is relatively small, it may be desirable to admix the primary charge stock with a suitable solvent or carrier hydrocarbon such as kerosene or diesel fuel, for example, before the introduction of the charge stock into the hydrogenation reaction zone.

In accordance with the subject invention, the hydrocarbonaceous charge stock is introduced into a hydrogenation zone and is contacted with a hydrogen-rich gaseous phase and a hydrogenation catalyst. The catalytic hydrogenation zone may contain a fixed, ebullated or fluidized catalyst bed. This reactin zone is preferably maintained under an imposed pressure from about 100 psig (2068 kPa gauge) to about 2000 psig (13790 kPa gauge) and more preferably under a pressure from about 200 psig (1379 kPa gauge) to about 1800 psig (12411 kPa gauge). Suitably, such reaction is conducted with a maximum catalyst bed temperature in the range of about 350° F. (177° C.) to about 850° F. (454° C.) selected to perform the desired hydrogenation conversion to reduce or eliminate the undesirable characteristics or components of the hydrocarbonaceous charge stock. Further preferred operating conditions include liquid hourly space velocities in the range from about 0.2 $hr^{-1}$ to about 10 $hr^{-1}$and hydrogen circulation rates from about 200 standard cubic feet per barrel (SCFB) (35.6 $m^3/m^3$) to about 10,000 SCFB (1778 $m^3/m^3$), preferably from about 300 SCFB (53.3 $m^3/m^3$) to about 8000 SCFB (1422 $m^3/m^3$).

The preferred catalytic composite disposed within the hereinabove described hydrogenation zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier materials are alumina, silica and mixtures thereof. Suitable metallic components having hydrogenation activity are those selected from the group comprising the metals of Groups VI-B and VIII of the Periodic Table, as set forth in the *Periodic*

*Table of the Elements*, E. H. Sargent and Company, 1964. Thus, the catalytic composites may comprise one or more metallic components from the group of molybdenum, tungsten, chromium, iron, cobalt, nickel, platinum, iridium, osmium, rhodium, ruthenium, and mixtures thereof. The concentration of the catalytically active metallic component, or components, is primarily dependent upon a particular metal as well as the physical and/or chemical characteristics of the particular hydrocarbon feedstock. For example, the metallic components of Group VI-B are generally present in an amount within the range of from about 1 to about 20 weight percent, the iron-group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state. In addition, any catalyst employed commercially for hydrogenating middle distillate hydrocarbonaceous compounds to remove nitrogen and sulfur should normally function effectively in the hydrogenation zone of the present invention.

The hydrocarbonaceous effluent from the hydrogenation zone is contacted with an aqueous scrubbing solution and the admixture is admitted to a separation zone in order to separate a spent aqueous stream contaminated with trace quantities of hydrocarbonaceous compounds, a hydrogenated hydrocarbonaceous phase and a hydrogen-rich gaseous phase. The contact of the hydrocarbonaceous effluent from the hydrogenation zone with the aqueous scrubbing solution may be performed in any convenient manner and is preferably conducted by co-current, in-line mixing which may be promoted by inherent turbulence, mixing orifices or any other suitable mixing means. The aqueous scrubbing solution is preferably introduced in an amount from about 1 to about 40 volume percent based on the hydrocarbonaceous effluent from the hydrogenation zone. The aqueous scrubbing solution is selected depending on the characteristics of the hydrocarbonaceous charge stock. For example, if the hydrocarbonaceous charge stock comprises halogenated compounds, the aqueous scrubbing solution preferably contains a basic compound such as calcium hydroxide, potassium hydroxide or sodium hydroxide in order to neutralize the acid which is formed during the hydrogenation of the halogen compounds. In the event that the hydrocarbonaceous charge stock contains only sulfur and nitrogen compounds, pure water is a suitable aqueous scrubbing solution. The resulting hydrogenated hydrocarbonaceous phase is recovered and the hydrogen-rich gaseous phase may be recycled to the hydrogenation zone if desired.

In accordance with the subject invention, at least a portion of the spent aqueous solution containing trace quantities of hydrocarbons and at least one water-soluble inorganic compound produced from the reaction of the hydrocarbonaceous charge stock and hydrogen which solution is recovered from a separation zone is contacted with a suitable adsorbent which selectively retains the trace hydrocarbonaceous compounds and produces an aqueous stream with a reduced concentration of hydrocarbonaceous compounds. Suitable adsorbents may be selected from materials which exhibit the primary requirement of hydrocarbonaceous selectivity and which are otherwise convenient to use. Suitable adsorbents include, for example, molecular sieves, amorphous silicaalumina gel, silica gel, activated carbon, activated alumina and clays. Of course, it is recognized that for a given case, a particular adsorbent may give better results than others.

The selected adsorbent is contacted with the spent aqueous solution containing at least one water-soluble inorganic compound and trace quantities of hydrocarbons in an adsorption zone. The adsorbent may be installed in the adsorption zone in any suitable manner. A preferred method for the installation of the adsorbent is in a fixed bed arrangement. The adsorbent may be installed in one or more vessels and in either series or parallel flow. The flow of spent aqueous solution through the adsorption zone is preferably performed in a parallel manner so that when one of the adsorbent beds or chambers is spent by the accumulation of hydrocarbonaceous compounds thereon, the spent zone may be bypassed while continuing uninterrupted operation through the parallel adsorption zone. The spent zone of adsorbent may then be regenerated or the spent adsorbent may be replaced as desired.

In a preferred embodiment of the subject invention, the spent zone of adsorbent is regenerated by isolating the spent adsorption zone and contacting the eluting said hydrocarbonaceous compounds from said adsorbent to thereby regenerate the adsorbent. Then the recovered hydrocarbonaceous compounds are introduced into the hydrogenation zone in order to recover the hydrocarbonaceous compounds. In general, the hydrocarbons may be removed from the adsorbent by means of an elution solvent which possesses a high solvent selectivity towards the hydrocarbonaceous compounds adsorbed on the adsorbent and which has no deleterious effect on the absorbent. Also preferred for use in the elution step are high temperature water or steam. However, any elution solvent which effectively satisfies the above mentioned criterion may be used.

During adsorption, the adsorption zone is preferably maintained at a pressure from about 10 psig (69 kPa gauge) to about 1500 psig (10342 kPa gauge), a temperature from about 32° F. (0° C.) to about 300° F. (149° C.) and a liquid hourly space velocity from about 0.1hr$^{-1}$ to about 500 hr$^{-1}$. The flow of the spent aqueous stream containing trace quantities of hydrocarbonaceous compounds through the adsorption zone may be conducted in an upflow, downflow or radial flow manner. The temperature and pressure of the adsorption zone are preferably selected to maintain the aqueous stream in the liquid phase.

During regeneration of the adsorbent, the adsorption zone is preferably maintained at a pressure from about 5 psig (35 kPa gauge) to about 1500 psig (10342 kPa gauge), and a temperature from about 32° F. (0° C.) to about 300° F. (149° C). The flow of the elution solvent through the adsorption zone during regeneration thereof may be conducted in an upflow, downflow or radial flow manner. The elution solvent during the regeneration of adsorbent may be present in a gas phase, a liquid phase or a mixture thereof.

In accordance with the subject invention, the admixture of elution solvent and the hydrocarbonaceous compounds which are removed from the adsorbent during regeneration thereof is introduced into the hydrogenation reaction zone. This is particularly advantageous in the case where the recovered hydrocarbonacous compound from the adsorbent are toxic, carcinogenic or otherwise obnoxious and are thereby in need of safe and appropriate disposal. The admixture of elution solvent and recovered hydrocarbonaceous compounds may be admixed with the fresh charge and introduced into the hydrogenation reaction zone, or may be directly charged to the hydrogenation reaction zone.

In the drawing, the process of the present invention is illustrated by means of a simplified flow diagram in which such details as pumps, instrumentation, heat-exchange and heat-recovery circuits, compressors and similar hardware have been deleted as being non essential to an understanding of the techniques involved. The use of such miscellaneous appurtenances are well within the purview of one skilled in the art.

With reference now to the drawing, a hydrocarbonaceous waste stream is introduced into the process via conduit 1 and subsequently passed to hydrogenation reaction zone 3. A hydrogen-rich gaseous stream which is derived in a manner hereinafter described is introduced via conduits 2 and 1 into hydrogenation reaction zone 3. The hydrocarbonaceous waste stream is hydrogenated in hydrogenation reaction zone 3 in the presence of a hydrogenation catalyst maintained at hydrogenation conditions as described hereinabove to simultaneously increase the hydrogen content of the hydrocarbonaceous charge stock and to generate at least one water-soluble inorganic compound produced from the reaction of the hydrocarbonaceous charge stock and the hydrogen. The resulting hydrogenated hydrocarbonaceous waste stream and a gaseous phase are removed from hydrogenation reaction zone 3 via conduit 4 and contacted after cooling with an aqueous scrubbing solution introduced via conduit 5. The resulting mixture is introduced via conduit 4 into high pressure separator 6. A hydrogen-rich gaseous phase is removed from high pressure separator 6 via conduit 2 and recycled as described hereinabove. Make-up hydrogen is introduced via conduit 32, conduit 2 and conduit 1 into hydrogenation reaction zone 3. A detoxified hydrocarbonaceous stream is removed from high pressure separator 6 via conduit 7 and recovered. A spent aqueous scrubbing solution containing trace quantities of hydrogenated hydrocarbonaceous compounds and at least a portion of the water-soluble inorganic compound produced from the reaction of the hydrocarbonaceous charge stock and the hydrogen is removed from high pressure separator 6 via conduit 8 and is introduced into adsorption zone 12 via conduit 9, valve 10 and conduit 11. Alternatively, the spent aqueous scrubbing solution is introduced to adsorption zone 20 which is located in parallel with adsorption zone 12 via conduit 17, valve 18, and conduit 19. A spent aqueous stream having a reduced concentration of hydrocarbonaceous compounds and containing at least a portion of the water-soluble inorganic compound produced is removed from adsorption zone 12 via conduit 13, and conduit 14, valve 15, conduit 16 and recovered. In the alternative, a spent aqueous stream having a reduced concentration of hydrocarbonaceous compound is removed from adsorption zone 20 via conduit 21, valve 22, conduit 23, conduit 16 and recovered. In the event adsorption zone 20 is to be regenerated, valves 18 and 22 are closed for isolation and an elution solvent is introduced via conduit 24, valve 26, conduit 24, and conduit 21 into adsorption zone 20. An elution solvent rich in hydrocarbonaceous compounds which have been extracted from adsorption zone 20 is removed via conduit 19, conduit 28, valve 29 and conduit 1 and is introduced into hydrogenation reaction zone 3. In the event that adsorption zone 12 is to be regenerated, valves 10 and 15 are closed for isolation and an elution solvent is introduced via conduit 24, conduit 25, valve 27 and conduit 13 into adsorption zone 12. An elution solvent rich in hydrocarbonaceous compounds is removed from adsorption zone 12 via conduit 11, conduit 30, valve 31, conduit 30, conduit 28, conduit 1 and introduced into hydrogenation reaction zone 3.

The process of the present invention is further demonstrated by the following illustrative embodiment. This illustrative embodiment is however not presented to unduly limit the process of this invention, but to further illustrate the advantages of the hereinabove described embodiments. The following data were not obtained by the actual performance of the present invention, but are considered prospective and reasonably illustrative of the expected performance of the invention.

ILLUSTRATIVE EMBODIMENT

This illustrative embodiment describes the hydrogenation of a hydrocarbonaceous waste stream comprising about 90 weight percent heavy naphtha and about 10 weight percent poly chlorinated biphenyl (PCB). PCB has been used commercially as a heat exchange medium in electrical transformers and has posed formidable disposal problems because of its carcinogenicity and resistance to bio- and photo-degradation in the environment. The conversion or destruction of PCB contained in hydrocarbonaceous waste streams to produce innocuous hydrocarbonaceous compounds is highly desirable.

The hereinabove described hydrocarbonaceous waste stream is introduced together with a gaseous hydrogen-rich stream into a hydrogenation reaction zone loaded with a catalyst comprising alumina, cobalt and molybdenum. The hydrogenation reaction is conducted with a catalyst peak temperature of 750° F. (399°C.), a pressure of 900 psig (6205 kPa gauge), a liquid hourly space velocity of 1 based on fresh feed and a hydrogen circulation rate of 2500 SCFB (444 std $m^3/m^3$). The hydrogenated effluent from the hydrogenation reaction zone including hydrogen chloride is cooled to about 100° F. (38°C.), contacted cocurrently with an aqueous scrubbing solution containing sodium hydroxide in an amount of 10 volume percent based on the hydrocarbonaceous effluent from the hydrogenation reaction zone and sent to a vapor-liquid high pressure separator wherein a gaseous hydrogen-rich stream is separated from the normally liquid hydrocarbonaceous products and spent aqueous scrubbing solution containing sodium and chloride ions. The resulting gaseous hydrogen-rich stream is then recycled to the hydrogenation zone together with a fresh supply of hydrogen in an amount sufficient to maintain the hydrogenation zone pressure. A hydrogenated hydrocarbonaceous stream having no detectable quantity of PCB is recovered from the high pressure separator. A spent aqueous neutralizing solution containing 50 weight parts per million (PPM) of hydrocarbonaceous compounds is also recovered from the high pressure separator and introduced into an adsorption zone loaded with activated carbon particles. The operating conditions of the adsorption zone include a pressure of about 25 psig (172 kPa gauge), a temperature of 80° F. (27° C.) and a liquid hourly space velocity of about 10. The aqueous effluent is removed from the adsorption zone and is found to have less than 1 PPM of hydrocarbonaceous compounds. A spent adsorption zone which becomes unable to produce an aqueous effluent free from hydrocarbonaceous compounds is isolated and the spent adsorption zone is regenerated by contacting the activated charcoal containing hydrocarbonaceous compounds with hot water at conditions which include a temperature of 200° F. (93° C.), and a pressure of about 25 psig (172 kPa gauge) for a time sufficient to elute or remove substantially all of the transient hydrocarbonaceous compounds from the activated carbon absorbent. The resulting admixture comprising hot water and entrained hydrocarbonaceous compounds removed from the adsorbent is then introduced into the hydrogenation reaction zone. The regenerated adsorption zone may then be placed on line in order to remove additional hydrocarbonaceous compounds from spent aqueous neutralizing solution.

The foregoing description, drawing and illustrative embodiment clearly illustrate the advantages encompassed by the process of the present invention and the benefits to be afforded with the use thereof.

We claim as our invention:

1. A process for hydrogenating a hydrocarbonaceous charge stock containing nitrogen, sulfur or halogen-based impurities which process comprises the steps of:

(a) contacting said hydrocarbonaceous charge stock in the presence of hydrogen with a hydrogenation catalyst in a hydrogenation reaction zone to simultaneously increase the hydrogen content of said hydrocarbonaceous charge stock and to generate at least one water-soluble inorganic nitrogen, sulfur or halogen-based compound produced from the reaction of said nitrogen, sulfur or halogen-based impurities in said hydrocarbonaceous charge stock with said hydrogen;

(b) contacting the reaction zone effluent containing hydrogenated hydrocarbon compounds and said at least one water-soluble inorganic compound with a fresh aqueous scrubbing solution;

(c) introducing the resulting admixture of said reaction zone effluent and said aqueous scrubbing solution into a separation zone to provide a hydrogenated hydrocarbon stream and s spent aqueous scrubbing solution stream containing at least a portion of said water-soluble inorganic compound and trace quantities of hydrogenated hydrocarbon compounds;

(d) contacting said spent aqueous scrubbing solution stream with an adsorbent to remove said trace quantities of said hydrocarbon compounds from said aqueous scrubbing solution stream thereby providing an aqueous stream essentially free from hydrocarbon compounds;

(e) eluting said hydrocarbon compounds from spent adsorbent thereby regenerating said adsorbent; and (f) passing said eluted hydrocarbon compounds which are removed from said spent adsorbent in step (e) into said hydrogenation reaction zone of step (a).

2. The process of claim 1 wherein said hydrocarbonaceous charge stock comprises hazardous organic compounds.

3. The process of claim 1 wherein said hydrogenation reaction zone is operated at conditions which include a pressure from about 100 psig (2068 kPa gauge) to about 2000 psig (13790 kPa gauge), a maximum catalyst temperature from about 350° F. (204° C.) to about 850° F.(454° C.) and a hydrogen circulation rate from about 200 SCFB (35.6 std $m^3/m^3$) to about 10,000 SCFB (1778 std $m^3/m^3$).

4. The process of claim 1 wherein said hydrogenation catalyst comprises a refractory inorganic oxide and at least one metallic compound having hydrogenation activity.

5. The process of claim 4 wherein said metallic compound is selected from the metals of Group VI-B and VIII of the Periodic Table.

6. The process of claim 1 wherein said aqueous scrubbing solution comprises an alkaline compound.

7. The process of claim 6 wherein said alkaline compound is sodium hydroxide, potassium hydroxide or calcium hydroxide.

8. The process of claim 1 wherein said adsorbent is silica gel, activated carbon, activated alumina, silica-alumina gel, clay, molecular sieves or admixtures thereof.

9. A process for regenerating a spent adsorbent which contains hydrocarbon compounds which process comprises the steps of:

(a) eluting said hydrocarbon compounds from said spent adsorbent and thereby regenerating said adsorbent; and (b) hydrogenating said hydrocarbon compounds removed from said spent adsorbent in step (a) to increase the hydrogen content thereof.

10. The process of claim 9 wherein said organic compounds are halogenated hydrocarbons or organometallic compounds.

11. The process of claim 10 wherein said hydrocarbon compounds are eluted from said adsorbent with hot water or steam.

* * * * *